US011202527B2

(12) United States Patent
Yu

(10) Patent No.: US 11,202,527 B2
(45) Date of Patent: Dec. 21, 2021

(54) ELECTRIC CURTAIN TRACK STRUCTURE

(71) Applicant: ARLINEA INDUSTRIES CO., Taoyuan (TW)

(72) Inventor: Yu-Heng Yu, Taoyuan (TW)

(73) Assignee: ARLINEA INDUSTRIES CO., Taoyuan (TW)

( * ) Notice: Subject to any disclaimer, the term of this patent is extended or adjusted under 35 U.S.C. 154(b) by 296 days.

(21) Appl. No.: 16/406,629

(22) Filed: May 8, 2019

(65) Prior Publication Data

US 2020/0352380 A1 Nov. 12, 2020

(51) Int. Cl.
*A47H 1/04* (2006.01)
*A47H 5/032* (2006.01)
*A47H 2/00* (2006.01)

(52) U.S. Cl.
CPC ..... *A47H 1/04* (2013.01); *A47H 2/00* (2013.01); *A47H 5/0325* (2013.01); *A47H 2001/042* (2013.01); *A47H 2001/045* (2013.01)

(58) Field of Classification Search
CPC .. A47H 1/04; A47H 5/0325; A47H 2001/042; A47H 2001/045; A47H 2001/006; A47H 2/00
See application file for complete search history.

(56) References Cited

U.S. PATENT DOCUMENTS 4,492,262 A * 1/1985 Comeau ..... A47H 5/0325 160/126
4,827,199 A * 5/1989 Kaucic ..... A47H 5/0325 160/331
5,513,419 A * 5/1996 Zinger ..... A47K 3/38 16/87.4 R
7,360,576 B2 * 4/2008 Lin ..... A47H 5/0325 160/168.1 P
2004/0026049 A1 * 2/2004 Park ..... A47H 5/02 160/331
2011/0168341 A1 * 7/2011 Bosgoed ..... A47H 5/0325 160/331
2012/0261370 A1 * 10/2012 Chuang ..... A47H 1/02 211/123
2015/0020622 A1 * 1/2015 Lin ..... F16H 19/0622 74/89.22
(Continued)

*Primary Examiner* — Catherine A Kelly
*Assistant Examiner* — Abe Massad
(74) *Attorney, Agent, or Firm* — Chun-Ming Shih; HDLS IPR SERVICES

(57) ABSTRACT

An electric curtain track structure includes a guiding track assembly, a first actuator, a transmission assembly and a decorative assembly. The guiding track assembly includes a guiding track main body having first and second bending sections opposite from each other. The first actuator is installed on the first bending section. The transmission assembly includes a transmission cable and first hooks. The transmission cable is inserted into the guiding track main body and driven by the first actuator to move along the guiding track main body. The decorative assembly includes a decorative panel and heads. The decorative panel is attached onto an outer side of the guiding track main body, and two ends of the decorative panel protruded out of the guiding track man body for the decorative heads to correspondingly install on an outer side of the first and second bending sections. Consequently, the overall appearance thereof is improved.

8 Claims, 4 Drawing Sheets

(56) References Cited

U.S. PATENT DOCUMENTS

| | | | | |
|---|---|---|---|---|
| 2015/0159430 | A1* | 6/2015 | Huang | E06B 9/368<br>160/168.1 P |
| 2015/0354274 | A1* | 12/2015 | Yu | A47H 5/0325<br>160/310 |
| 2016/0220055 | A1* | 8/2016 | Egami | E06B 9/364 |
| 2017/0002606 | A1* | 1/2017 | Yu | A47H 13/04 |
| 2018/0279818 | A1* | 10/2018 | Goelst | A47H 1/04 |

* cited by examiner

ELECTRIC CURTAIN TRACK STRUCTURE

BACKGROUND OF THE INVENTION

Field of the Invention

The technical field relates to a curtain track, in particular, to an electric curtain track structure.

Description of Related Art

To improve the stylish look and appearance, modern curtains are often installed with various types of decorative heads at the two ends of a horizontal curtain rod in order to present a unique style variation and visual sensation of the curtain, in light of increasing the overall quality appearance and economic benefit.

However, for electric curtains, since the rear ends of a curtain track are typically installed with actuators, the installation locations of the actuators can hinder the installation of the aforementioned decorative heads. Consequently, the decorative heads cannot be installed at the two ends of the curtain track, and the aesthetic appearance of the curtain is affected by the exposure of the actuators.

In view of above, the inventor seeks to overcome the aforementioned drawbacks associated with the currently existing technology after years of research and development along with the utilization of academic theories, which is also the objective of the development of the present invention.

SUMMARY OF THE INVENTION

An objective of the present invention is to provide an electric curtain track structure in order to allow the decorative heads to be installed onto the two ends of the decorative panel, such that the overall aesthetic appearance of the curtain can be improved.

To achieve the aforementioned objective, the present invention provides an electric curtain track structure comprising a guiding track assembly, a first actuator, a transmission assembly and a decorative assembly. The guiding track assembly comprises a guiding track main body having a first bending section and a second bending section opposite from each other. The first actuator is installed on the first bending section. The transmission assembly comprises a transmission cable and a plurality of first hooks. The transmission cable is inserted into the guiding track main body and driven by the first actuator in order to move along the guiding track main body together with the plurality of first hooks. The decorative assembly comprises a decorative panel and a pair of decorative heads. The decorative panel is attached onto an outer side surface of the guiding track main body, and two ends of the decorative panel respectively protruded out of the guiding track man body in order to allow the decorative heads to be correspondingly installed on an outer side of the first bending section and the second bending section respectively.

In comparison to prior arts, the electric curtain track structure of the present invention includes first bending section and the second bending section arranged opposite from each other, and the decorative panel of the decorative assembly is attached onto an outer side surface of the guiding track main body. In addition, the two ends of the decorative panel protrude out of the guiding track main body in order to allow the decorative heads to be correspondingly installed onto the outer sides of the first bending section and the second bending second. Accordingly, the decorative heads can be prevented from being hindered by the first actuator in order to be installed on the two ends of the decorative panel. Therefore, the first actuator can be concealed such that the aesthetic appearance is improved and the practicableness of the present invention is enhanced.

DETAILED DESCRIPTION OF THE INVENTION

Figure 1:
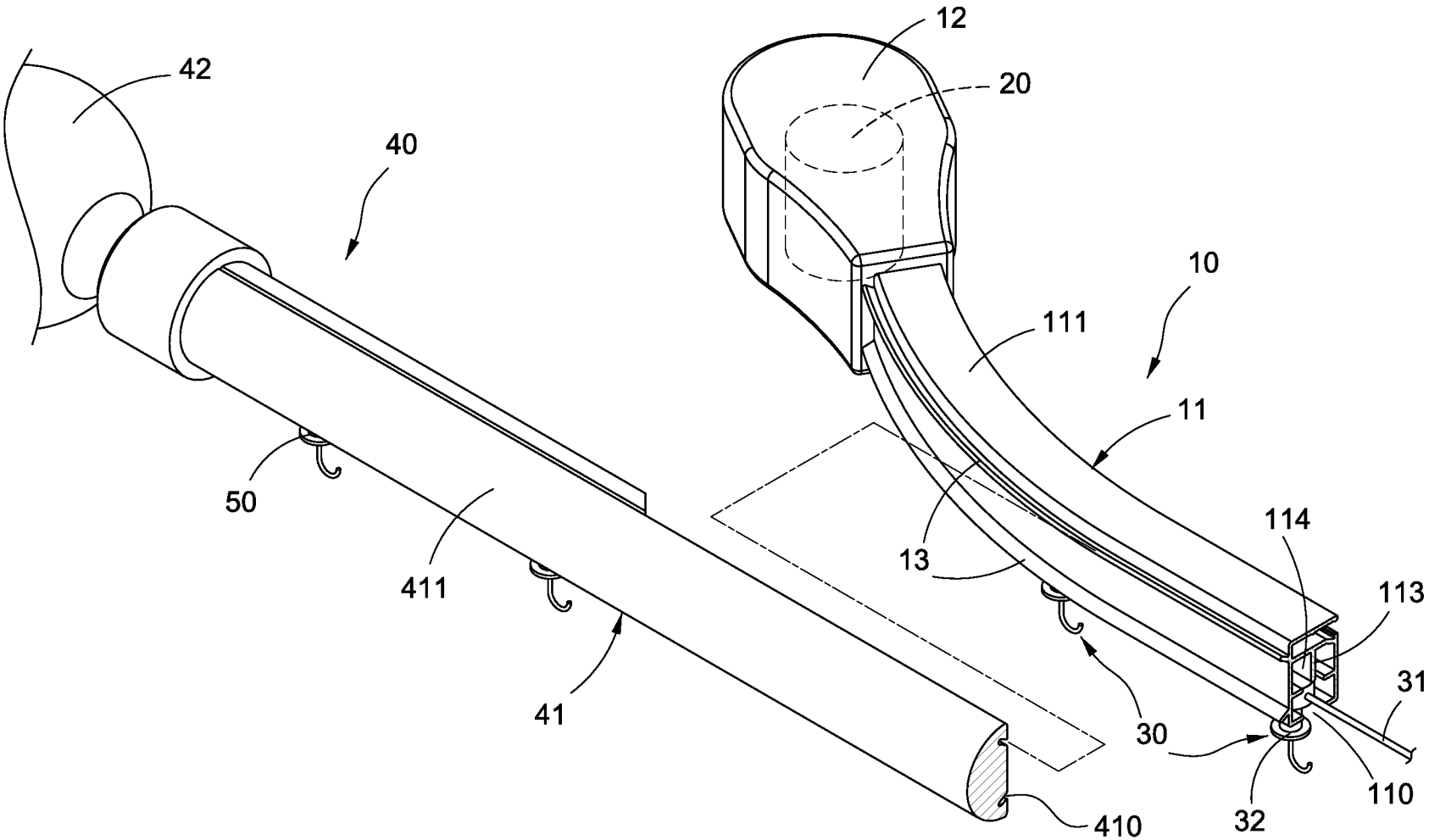
FIG. 1 is a perspective exploded view of the electric curtain track structure of the present invention.
Figure 2:
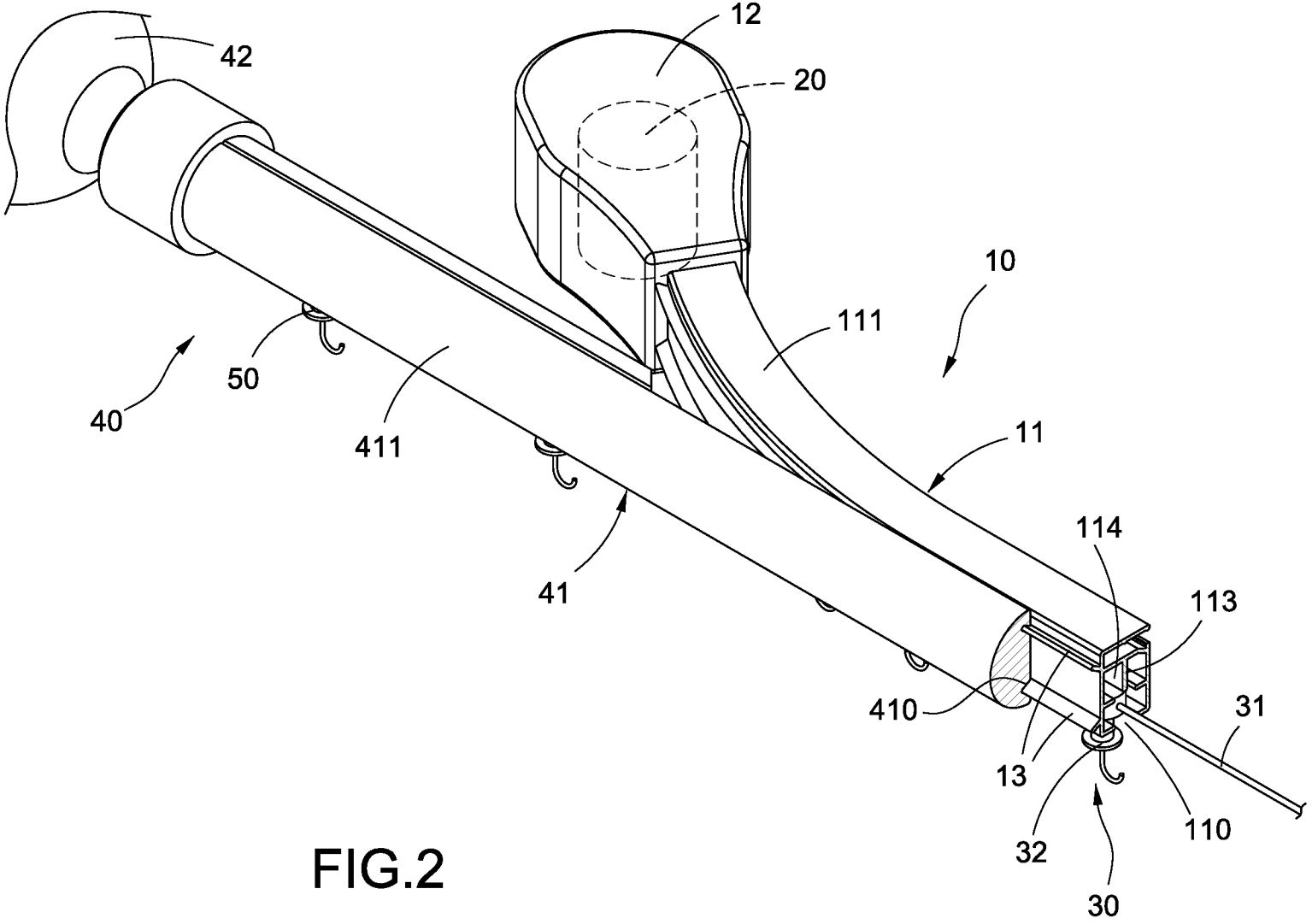
FIG. 2 is a partial perspective view of the electric curtain track structure of the present invention.

The following provides a detailed technical content of the present invention along with the accompanied drawings. However, the accompanied drawings are provided for reference and illustrative purpose only such that they shall not be used to limit the scope of the present invention.

Please refer to FIG. 1 to FIG. 4, respectively showing a perspective exploded view, a perspective side view, a partial attachment view and a top view of an electric curtain track structure according to an exemplary embodiment of the present invention. The present invention provides an electric curtain structure 1 comprising a guiding track assembly 10, a first actuator 20, a transmission assembly 30 and a decorative assembly 30. The transmission assembly 30 is arranged on the guiding track assembly 10 and is configured to move relative to the guiding track assembly 10 under the driving by the first actuator 20. In addition, the decorative assembly 40 is attached onto one side of the guiding track assembly 10 in order to increase the overall aesthetic appearance of the electric curtain track structure 1. Please refer to further detail of the electric curtain track structure as described in the following.

The guiding track assembly 10 comprises a guiding track main body 11. The guiding track main body 11 includes a first bending section 111 and a second bending section 112. In addition, the first bending section 111 and the second bending section 112 are bent toward an identical direction relative to one side of the guiding track main body 11.

In an exemplary embodiment of the present invention, the guiding track main body 11 is an aluminum extruded track. In addition, the guiding track main body 11 comprises a plurality of supporting plates 113 and a plurality of channels 114 formed among the plurality of supporting plates 113. It shall be noted that during the actual implementation, the guiding track main body 11 is not limited to such configuration only.

The first actuator 20 is a driving element, and preferably, it is configured to be a driving element, such as a motor etc., in order to drive the transmission assembly 30 to move. The first actuator 20 is installed on the first bending section 111 of the guiding track main body 11 or is installed adjacent to the first bending section 111.

In an exemplary embodiment of the present invention, the guiding track assembly 10 further comprises a first installation portion 12. In addition, the first installation portion 12 is arranged on the first bending section 111, and the first actuator 20 is located inside the first installation portion 12.

In addition, the transmission assembly 30 comprises a transmission cable 31 and a plurality of first hooks 32. The transmission cable 31 is inserted into the guiding track main body 11 and is driven by the first actuator 20 in order to move along the guiding track main body 11 together with the plurality of first hooks 32.

In an exemplary embodiment of the present invention, the guiding track main body 11 includes an open-type through slot 110. Furthermore, the transmission cable 31 is inserted into the through slot 110 in order to allow the plurality of first hooks 32 to be exposed on an outer side of the through slot 110 such that a curtain fabric (not shown in the drawings) can be mounted thereon.

The decorative assembly 40 comprises a decorative panel 41 and a pair of decorative heads 42. The decorative panel 41 is attached onto an outer side surface of the guiding track main body 11, and the two ends of the decorative panel 41 protrudes out of the guiding track main body 11 respectively in order to allow the pair of decorative heads 42 to be correspondingly installed onto an outer side of the first bending section 111 and the second bending section 112. Accordingly, the pair of decorative heads 42 can be installed onto the two ends of the decorative panels 41 without being hindered by the first actuator 20.

Figure 3:
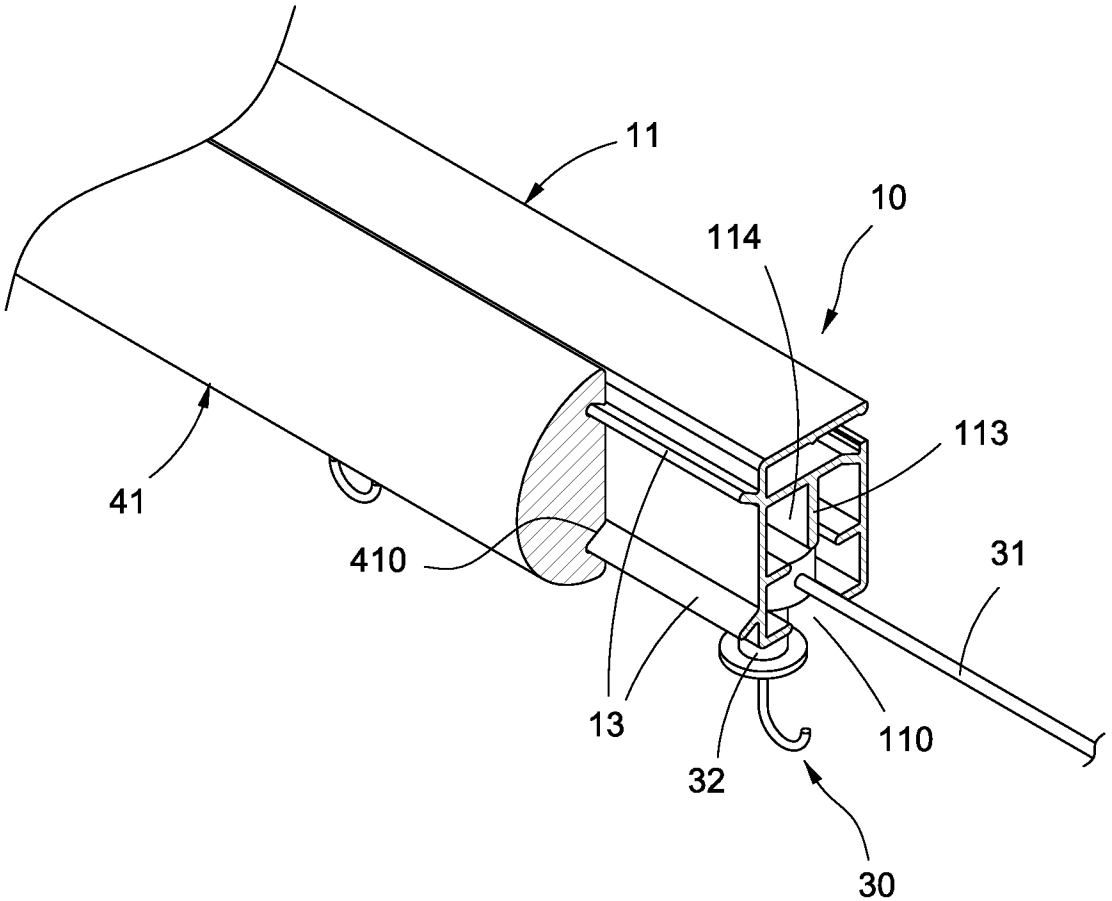
FIG. 3 is partial assembly view of the electric curtain track structure of the present invention.

As shown in FIG. 3, in an exemplary embodiment of the present invention, the guiding track main body 11 includes a set of protruding ribs 13 formed on one side thereof. In addition, the decorative panel 41 includes a set of grooves 410 formed on one side surface facing toward the guiding track main body 11. The decorative panel 41 is attached onto the set of protruding ribs 13 of the guiding track main body 11 with the set of grooves 410. In other words, the decorative panel 41 is slidably arranged onto the protruding ribs 13 of the guiding track main body 11 from one side end of the guiding track main body 11 with the set of grooves 410. Accordingly, the decorative panel 41 can be attached onto on side surface of the guiding track main body 11.

To be more specifically, the decorative panel 41 comprises a first installation section 411 and a second installation section 412 protruding out of the two ends of the guiding track main body 11. The pair of decorative heads 42 are mounted onto a rear end of the first installation section 411 and the second installation section 412 respectively.

In addition, the electric curtain track structure 1 further comprises a plurality of second hooks 50. The plurality of second hooks 50 are installed spaced apart from each other on the first installation section 411 and the second installation section 412, and are also located on two outer sides of the plurality of first hooks 32.

It shall be noted that during the actual implementation, the electric curtain track structure 1 may further comprise a second actuator 60. The second actuator 60 is installed onto the second bending section 112 and cooperates in conjunction with the first actuator 20 to jointly drive the transmission assembly 30 to move in order to further facilitate the operation of the electric curtain.

Figure 4:
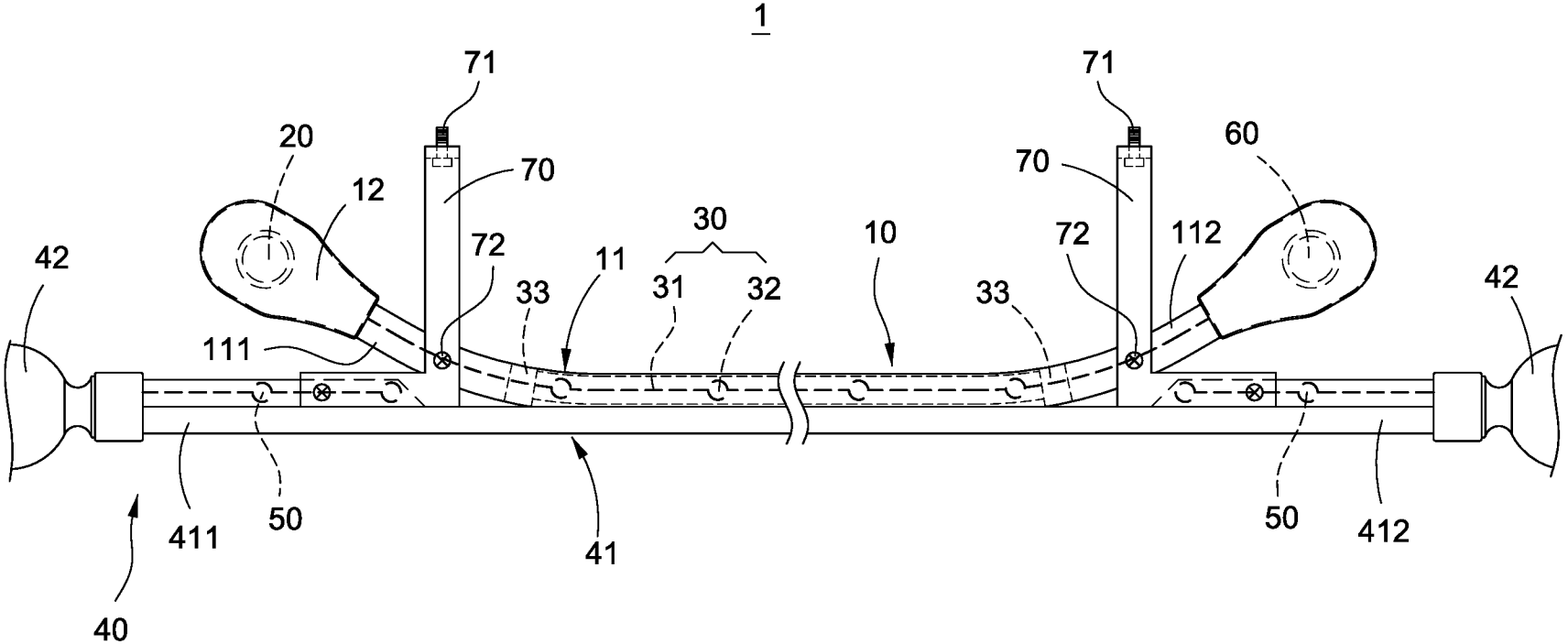
FIG. 4 is a top view of the electric curtain track structure of the present invention.

As shown in FIG. 4, the two ends of the decorative panel 41 of the electric curtain structure 1 of the present invention protrude out of the guiding track main body 11 respectively in order to allow the pair of decorative heads 42 to be installed onto an outer side of the first bending section 111 and the second bending section 112 correspondingly. Accordingly, the pair of decorative heads 42 can be installed onto the two ends of the decorative panel 41 without being hindered by the first actuator 20, and the first actuator 20 can also be concealed in order to improve the aesthetic appearance thereof.

Furthermore, the electric curtain track structure 1 of the present invention uses the plurality of second hooks 50 in conjunction with the plurality of first hooks 32 for the mounting of a curtain fabric (not shown in the drawings) in order to allow the length of the curtain fabric to extend to the first installation section 411 and the second installation section 412 of the decorative panel 41, such that it is able to achieve the effect of concealing the first actuator 20 as well as to further improve the overall asthenic appearance of the electric curtain track structure 1.

In addition, it shall be noted that in this exemplary embodiment, the transmission assembly 30 further comprises a retaining member 33. The retaining member 33 is arranged at one side of the transmission cable 31 adjacent to the installation portion 12 in order to be used for preventing the curtain fabric from overly closed crowding at one area that may affect the appearance thereof. Furthermore, the electric curtain track structure 1 may further comprises at least one supporting rack 70, and the supporting rack 70 is fastened onto one securement surface via a fastener 71. Moreover, the supporting rack 70 is used for supporting the transmission assembly 30. The transmission assembly 30 can be secured onto the supporting rack 70 at an appropriate location via another fastener 72, thereby supporting the weight of the transmission assembly 30 and the first actuator 20 as well as the second actuator 60.

The above describes the preferable and feasible exemplary embodiments of the present invention for illustrative purposes only, which shall not be treated as limitations of the scope of the present invention. Any equivalent changes and modifications made in accordance with the scope of the claims of the present invention shall be considered to be within the scope of the claim of the present invention.

What is claimed is:

1. An electric curtain track structure, comprising:

a guiding track assembly comprising a guiding track main body having a first bending section and a second bending section opposite from each other;

a first actuator installed on the first bending section;

a transmission assembly comprising a transmission cable and a plurality of first hooks; the transmission cable being inserted into the guiding track main body and driven by the first actuator in order to move along the guiding track main body together with the plurality of first hooks;

a decorative assembly comprising a decorative panel and a pair of decorative heads; the decorative panel being attached onto an outer side surface of the guiding track main body, and two ends of the decorative panel protruding out of the guiding track main body in order to allow the decorative heads to be correspondingly installed on an outer side of the first bending section and the second bending section respectively, wherein the decorative panel comprises a first installation section and a second installation section protruding out of two ends of the guiding track main body; the pair of decorative heads are mounted onto a rear end of the first installation section and the second installation section respectively, and wherein the transmission assembly further comprises a pair of retaining members arranged at both ends of the transmission cable adjacent to the first installation section and the second installation section respectively, such that the plurality of first hooks are limited to movement between the pair of retaining members;

at least one supporting rack fastened onto a securement surface via a first fastener, and the transmission assembly being secured onto the supporting rack at the first bending section via a second fastener; and a plurality of second hooks installed spaced apart from each other on the first installation section and the second installation section as well as located at two outer sides of the plurality of first hooks.

2. The electric curtain track according to claim 1, wherein the first bending section and the second bending section are bent toward an identical direction relative to one side of the guiding track main body.

3. The electric curtain track according to claim 1, wherein the guiding track main body includes an open through slot, and the transmission cable is inserted into the through slot in order to allow the plurality of first hooks to be exposed at an outer side of the through slot.

4. The electric curtain track according to claim 1, wherein the guiding track main body includes a set of protruding ribs formed on one side thereof; the decorative panel includes a set of grooves formed on one side surface facing toward the guiding track main body, and the decorative panel is attached onto the set of protruding ribs of the guiding track main body with the set of grooves.

5. The electric curtain track according to claim 1, wherein the guiding track main body is an aluminum extruded track, and the guiding track main body comprises a plurality of supporting plates and a plurality of channels are formed among the plurality of supporting plates.

6. The electric curtain track according to claim 1, wherein the guiding track assembly further comprises a first installation portion; the first installation portion is arranged on the first bending section, and the first actuator is located inside the first installation portion.

7. The electric curtain track according to claim 1, wherein the first actuator is a motor.

8. The electric curtain track according to claim 1, further comprising a second actuator installed on the second bending section.

* * * * *